US009598200B2

(12) United States Patent
Lee et al.

(10) Patent No.: US 9,598,200 B2
(45) Date of Patent: Mar. 21, 2017

(54) CONNECTION DIE COUPLED WITH CONTAINER NECK IN USE

(76) Inventors: Jeong-Min Lee, Seoul (KR); Seong-Jae Lee, Seoul (KR)

( * ) Notice: Subject to any disclaimer, the term of this patent is extended or adjusted under 35 U.S.C. 154(b) by 1344 days.

(21) Appl. No.: 14/412,857

(22) PCT Filed: Nov. 19, 2010

(86) PCT No.: PCT/KR2010/008167

§ 371 (c)(1),
(2), (4) Date: Feb. 17, 2015

(87) PCT Pub. No.: WO2011/062432

PCT Pub. Date: May 26, 2011

(65) Prior Publication Data

US 2015/0158621 A1 Jun. 11, 2015

(30) Foreign Application Priority Data

Nov. 17, 2009 (KR) ..... 10-2009-0111754
Dec. 7, 2009 (KR) ..... 10-2009-0121651
(Continued)

(51) Int. Cl.
*B65D 41/01* (2006.01)
*B65D 41/34* (2006.01)
(Continued)

(52) U.S. Cl.
CPC ..... *B65D 1/0246* (2013.01); *B65D 45/325* (2013.01); *B65D 47/123* (2013.01);
(Continued)

(58) Field of Classification Search
CPC ..... B65D 1/0246; B65D 2101/0023; B65D 2251/08; B65D 47/2006; B65D 47/127; B65D 47/305; B65D 47/245; F16L 55/1152
(Continued)

(56) References Cited

U.S. PATENT DOCUMENTS 2,218,308 A * 10/1940 Comer ..... B65D 47/20 215/317
2,703,670 A * 3/1955 Voight ..... B67C 11/02 141/340
(Continued)

FOREIGN PATENT DOCUMENTS

JP 2008-100767 A 5/2008
KR 10-2004-0014616 A 2/2004
(Continued)

OTHER PUBLICATIONS

International Search Report dated Sep. 1, 2011, mailed Sep. 2, 2011.
(Continued)

*Primary Examiner* — J. Gregory Pickett
*Assistant Examiner* — Gideon Weinerth
(74) *Attorney, Agent, or Firm* — Norris McLaughlin & Marcus PA

(57) ABSTRACT

Disclosed is a connection device to be coupled with a container neck in different standards for use. The connection device is formed with a mouth part at the upper side and a screw thread part at the lower side. The mouth part at the upper portion of the connection device is formed in a screw thread or other shape in the standard corresponding to a bottle lid, and the inside of the screw thread part is formed with a screw thread corresponding to the standard of the container neck. The screw thread is integrally formed or an elastic screw thread is additionally added for the coupling with the necks of a plurality of containers.

18 Claims, 16 Drawing Sheets

(30) Foreign Application Priority Data

Apr. 22, 2010 (KR) ..... 10-2010-0038091
Nov. 18, 2010 (KR) ..... 10-2010-0115253

(51) Int. Cl.
*B65D 1/02* (2006.01)
*B65D 45/32* (2006.01)
*B65D 47/12* (2006.01)
*B65D 47/24* (2006.01)
*B65D 41/04* (2006.01)

(52) U.S. Cl.
CPC ..... *B65D 47/243* (2013.01); *B65D 41/0421* (2013.01); *B65D 2101/0023* (2013.01); *B65D 2251/08* (2013.01)

(58) Field of Classification Search
USPC ..... 215/44, 319, 316; 220/287; 138/96 R, 138/96 T, 89–95; 206/222
See application file for complete search history.

(56) References Cited

U.S. PATENT DOCUMENTS 3,069,040 A * 12/1962 Corsette ..... B65D 41/0421 215/318
3,157,304 A * 11/1964 Judge ..... B65D 43/0212 215/253
3,537,623 A * 11/1970 Fisher ..... B65D 47/122 222/460
3,807,457 A * 4/1974 Logsdon ..... F16L 55/1141 138/89
4,266,813 A * 5/1981 Oliver ..... F16L 25/14 285/12
4,296,786 A * 10/1981 Brignola ..... A61J 1/2089 141/309
4,542,833 A * 9/1985 DeVaughn ..... B65D 41/22 215/319
4,583,668 A * 4/1986 Maynard, Jr. ..... B65D 25/48 141/367
5,450,973 A * 9/1995 Ellis ..... B65D 41/0421 215/252
5,465,835 A * 11/1995 Schumacher ..... B65D 81/3222 206/219
5,472,025 A * 12/1995 Conrad ..... B65B 39/007 141/331
5,678,720 A * 10/1997 Van Melle ..... B65D 43/0212 215/317
5,915,418 A * 6/1999 Turner ..... F16L 55/1152 138/89
5,927,353 A * 7/1999 Persson ..... B65B 39/00 141/331
6,112,922 A * 9/2000 Nofer ..... B65D 41/0421 215/252
6,408,887 B2 * 6/2002 Rahimzadeh ..... F16L 55/115 138/96 R
6,415,937 B1 * 7/2002 DeJong ..... A61J 11/04 215/11.1
6,425,424 B1 * 7/2002 Ellis Calvo ..... B65B 39/00 141/331
6,435,341 B1 * 8/2002 Nobbio ..... B65D 41/3442 206/219
6,851,565 B2 * 2/2005 Stephan ..... B65D 47/06 215/11.1
6,875,205 B2 * 4/2005 Leinsing ..... A61J 1/2089 206/828
6,935,380 B2 * 8/2005 Rahimzadeh ..... F16L 55/115 138/89
7,513,377 B1 * 4/2009 Culley ..... B65D 41/3428 215/252
7,857,172 B2 * 12/2010 Harvey ..... B05B 11/3047 215/319
8,365,934 B2 * 2/2013 Hamana ..... B65D 41/3428 215/253
8,485,353 B2 * 7/2013 Lee ..... B65D 47/243 206/219
8,807,362 B2 * 8/2014 Lee ..... B65D 47/2006 206/219
8,985,360 B2 * 3/2015 Chen ..... B67D 7/06 141/311 R
9,067,715 B2 * 6/2015 Lee ..... B65D 41/0421
9,242,772 B1 * 1/2016 Anderson ..... B65D 51/2835
9,409,364 B2 * 8/2016 Anthony ..... B29D 99/0096
2001/0035223 A1 * 11/2001 Rahimzadeh ..... F16L 55/115 138/96 R
2004/0011758 A1 * 1/2004 Wallace ..... B65D 45/34 215/275
2004/0124170 A1 * 7/2004 Sherrod ..... A47G 19/2272 215/319
2005/0155659 A1 * 7/2005 Rahimzadeh ..... F16L 55/115 138/96 R
2006/0138073 A1 * 6/2006 Ooka ..... B65D 41/325 215/344
2007/0029345 A1 * 2/2007 Lee ..... B01F 3/12 222/145.1
2007/0045134 A1 * 3/2007 Dvorak ..... B65D 51/2835 206/222
2009/0120894 A1 * 5/2009 Kario ..... A47G 19/2272 215/11.1
2010/0012532 A1 * 1/2010 Frutin ..... B65D 51/2864 206/221
2010/0018972 A1 * 1/2010 Kao ..... B65D 51/1633 220/212
2010/0163442 A1 * 7/2010 Lee ..... B65D 47/243 206/222
2010/0163509 A1 * 7/2010 Canziani Hoffa ... B65D 47/243 215/228
2011/0163103 A1 * 7/2011 Lee ..... B65D 41/0421 220/521
2012/0217178 A1 * 8/2012 Rohr ..... B65D 41/04 206/219
2012/0305519 A1 * 12/2012 Lee ..... B65D 47/2006 215/316
2014/0144864 A1 * 5/2014 Lee ..... B65D 51/28 215/6
2015/0158621 A1 * 6/2015 Lee ..... B65D 45/325 215/44
2015/0217924 A1 * 8/2015 Cho ..... B65D 51/2892 206/219
2015/0232243 A1 * 8/2015 Lee ..... B65D 51/2864 206/221
2015/0239638 A1 * 8/2015 Lee ..... B65D 51/285 206/222
2015/0266651 A1 * 9/2015 Lee ..... B65D 51/2842 215/227
2015/0307241 A1 * 10/2015 Lee ..... B65D 47/247 206/219

FOREIGN PATENT DOCUMENTS

KR 10-2005-0109017 A 11/2005
KR 10-2009-0056748 A 6/2009

OTHER PUBLICATIONS

English Translation of International Search Report dated Sep. 1, 2011, mailed Sep. 2, 2011.

* cited by examiner

CONNECTION DIE COUPLED WITH CONTAINER NECK IN USE

This application is a 371 application of PCT/KR2010/008167 filed Nov. 19, 2010, which claims foreign priority benefit under 35 U.S.C. §119 of Korean application Nos. 10-2009-0111754, filed Nov. 17, 2009; 10-2009-0121651, filed Dec. 7, 2009; 10-2010-0038091, filed Apr. 4, 2010; and 10-2010-0115253, filed Nov. 11, 2018, the disclosures of which are incorporated herein in their entirety.

TECHNICAL FIELD

The present invention relates to a connection device used to be coupled to a container neck, which is separately provided so that a bottle lid is assembled with different kinds of container necks having different standards.

BACKGROUND ART

There is a related art disclosed in PCT/KR2008/4210 which was invented by the present inventor.

DISCLOSURE OF THE INVENTION

Technical Problem

In the case of PCT/KR2008/4210 that is a related art, for example, a screw thread having a size of about 26.78 MM to about 28 MM is formed within a bottle lid. In addition, one bottle lid may be assembled with a container neck having a size of about 26.78 MM and a container neck having a size of about 28 M.

Objectives of the present invention are to clarify examples in use of the technical structure, and preferably, the standard of the bottle lid is predetermined, and a connection die for assisting the coupling of the bottle lid to a container neck having a standard different from that of the bottle lid.

Technical Solution

A connection device of the present invention is separately provided to be coupled to a bottle lid and a container neck which have different sizes and has a screw thread so that the connection device is coupled to an inner screw thread of the bottle lid and a mouth part screw thread of the container neck.

As an example of the present invention, when the inner screw thread of the bottle lid has a size of about 28 MM, and the container neck has a size of about 26.78 MM, a separate connection device is provided. Here, a screw thread coupled to the bottle lid is formed on an upper portion of the connection device, and a screw thread coupled to the container neck having a size of about 26.78 MM is formed on a lower portion of the connection device.

Also, a first screw thread and a second screw thread which have different sizes from each other may be formed on a lower inner sidewall of a connection die so that one connection device is applied to a plurality of container necks having different sizes.

Advantageous Effects

Even though the bottle lid has a size different from that of container neck, the connection device is separately provided to assist the coupling of the bottle neck to the container neck, which have different sizes from each other, and thus it is unnecessary to manufacture bottle lids or container necks having various sizes separately.

MODE FOR CARRYING OUT THE INVENTION

Figure 1:
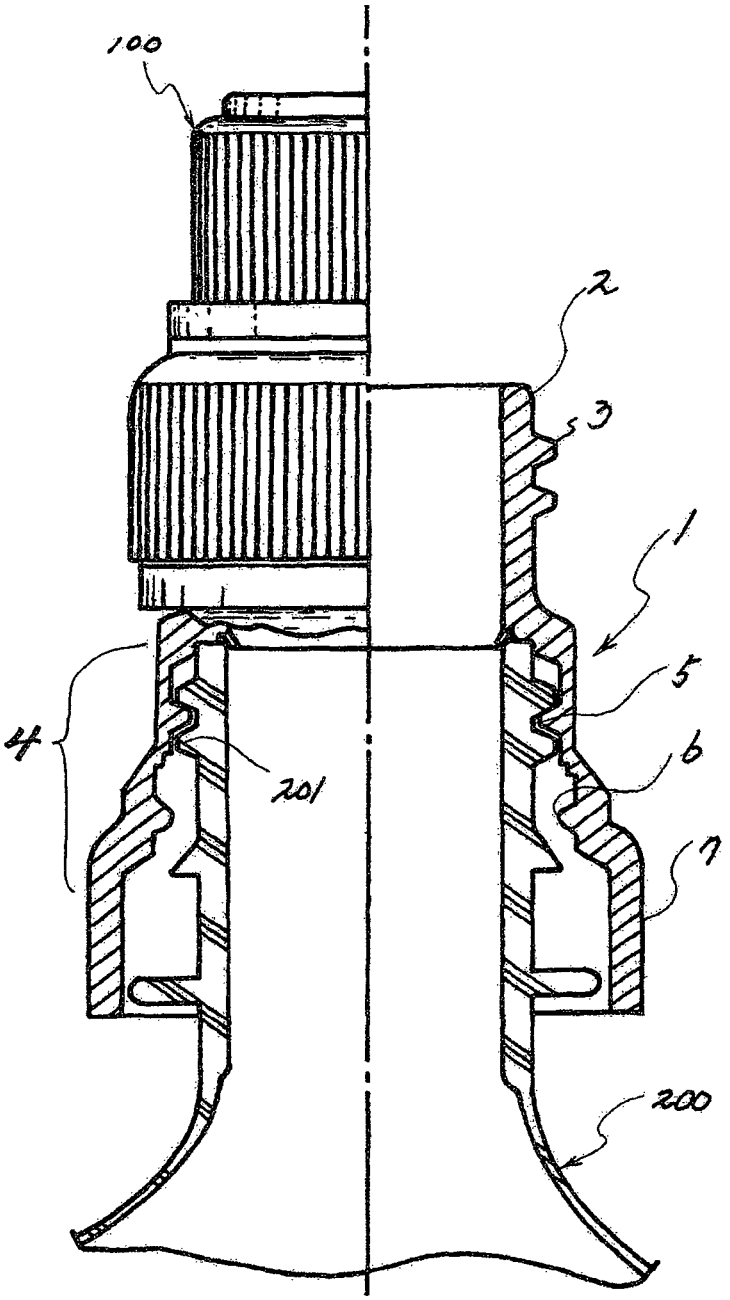
FIG. 1 is a cross-sectional view of a preferred embodiment of the present invention.

A connection device 1 of the present invention includes a mouth part 2 and a lower coupling part 4. A mouth part screw thread 3 that is coupled to an inner screw thread of a bottle lid 100 is disposed on an outer circumferential portion of the mouth part 2. A screw thread corresponding to a standard of a specific container neck is disposed in a screw thread part 4 that is the lower coupling part.

Also, the screw thread disposed within the screw thread part 4 that is the lower coupling part includes a first screw thread 5 and a second screw thread 6. The screw thread of one connection device 1 is configured to be coupled to necks of containers having a plurality of standards different from each other. For this, the screw thread part 4 in which the first screw thread 5 is disposed may have a thin thickness so that the screw thread part 4 is instantly expanded and assembled when a screw thread 201 of a container neck 200 is large.

Also, for example, the screw thread part 4 has a structure in which the first screw thread 5 is formed to be coupled to the container neck 200 having the screw thread 201 having a size of about 26.78 MM, and the second screw thread 6 is formed to be coupled to a container neck having a size of about 26.78 MM or more at lower side of the first screw thread 5. Thus, one bottle lid 100 may be coupled to a plurality of container necks.

Reference numeral 7 of drawings which is not described shows a guide.

Figure 2:
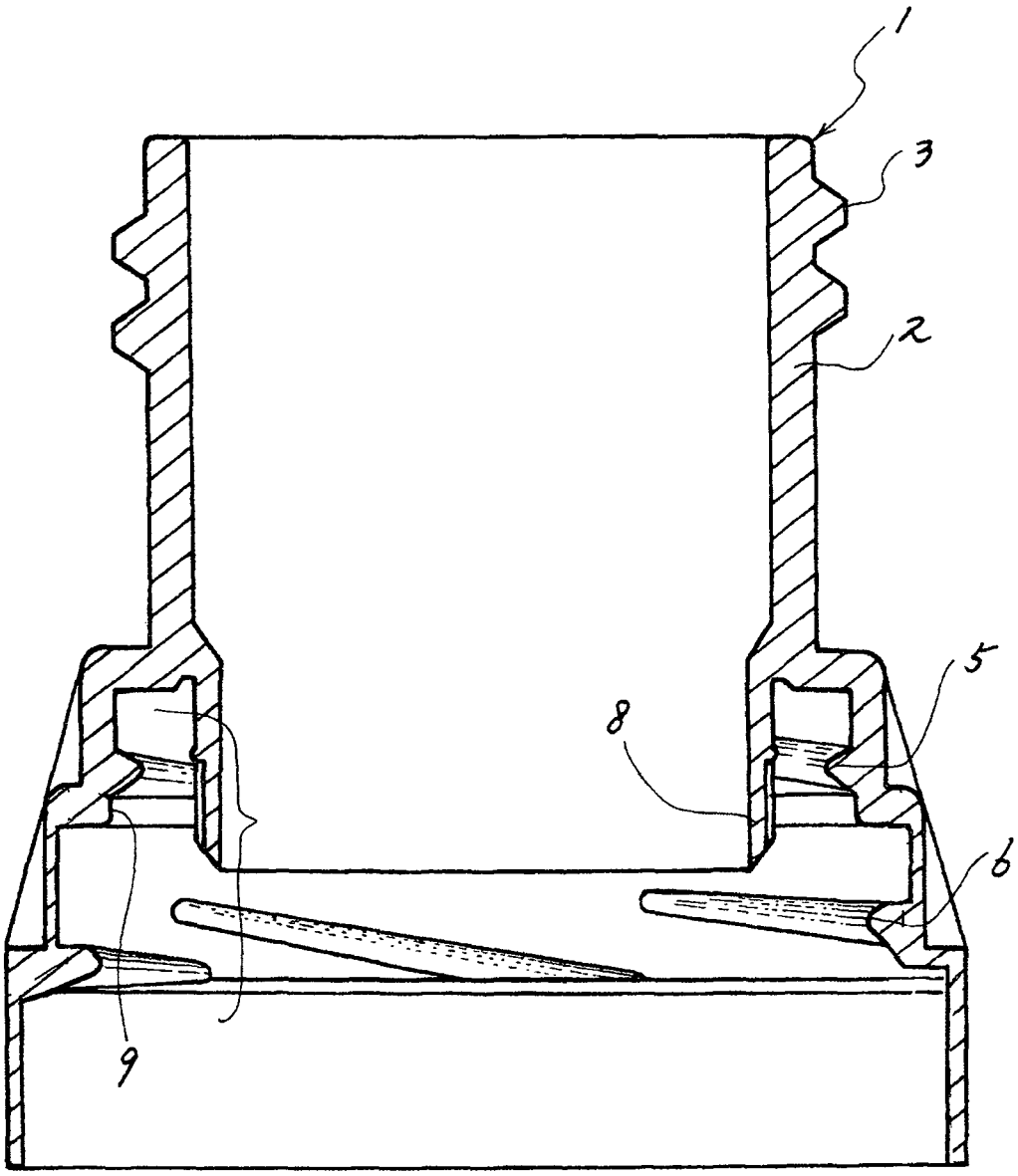
FIG. 2 is a cross-sectional view of another embodiment of the present invention.

In another embodiment (FIGS. 2 to 6 are expanded cross-sectional views), in FIG. 2, the first screw thread 5 is a screw thread that is capable of being coupled to a container neck having a size of about 26.78 MM, and the second screw thread 6 is a screw thread that is capable of being coupled to a container neck having a size of about 30 MM.

Figure 3:
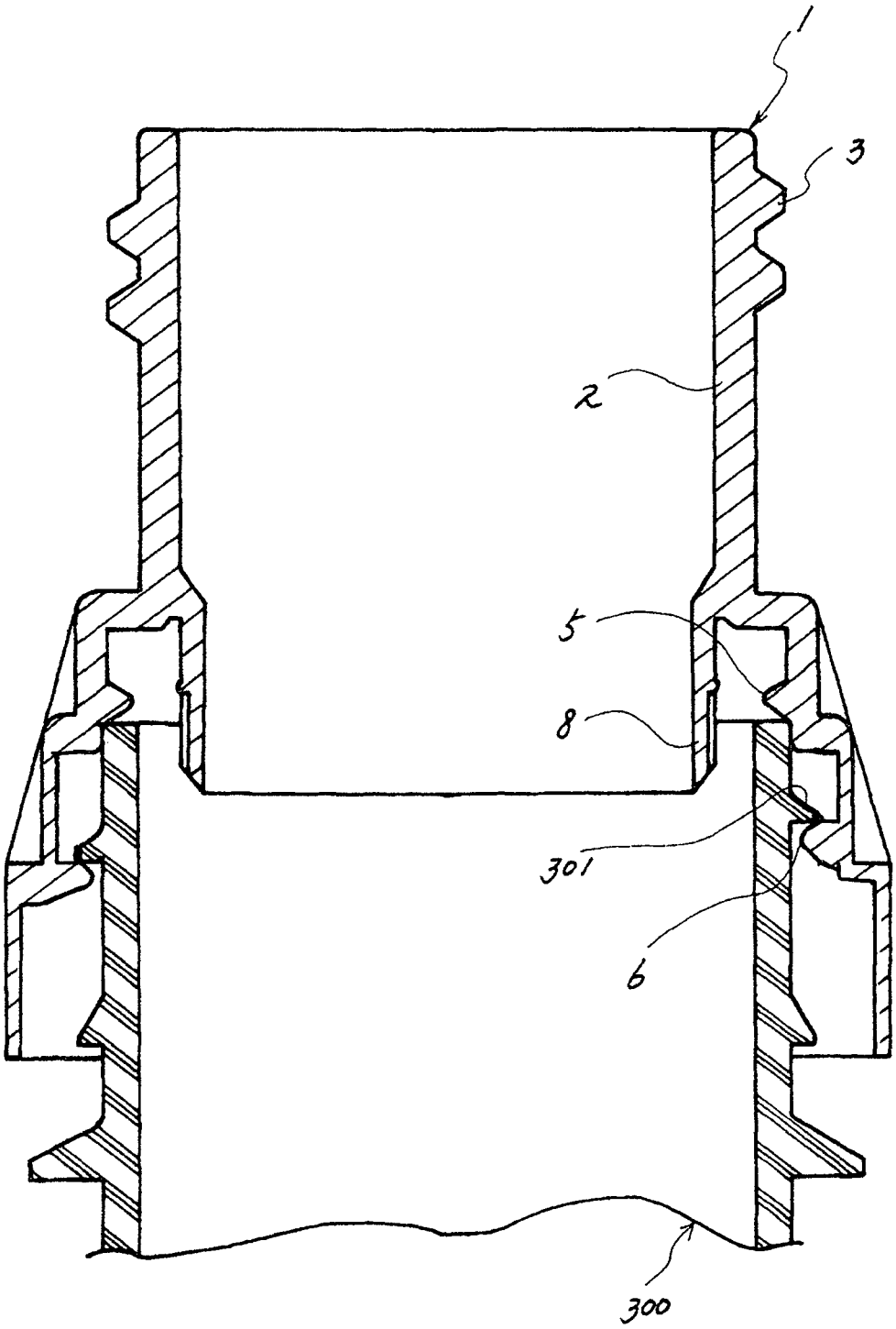
FIGS. 3 and 4 are cross-sectional and semi-cross sectional views illustrating a state which is assembled with a container neck.
Figure 4:
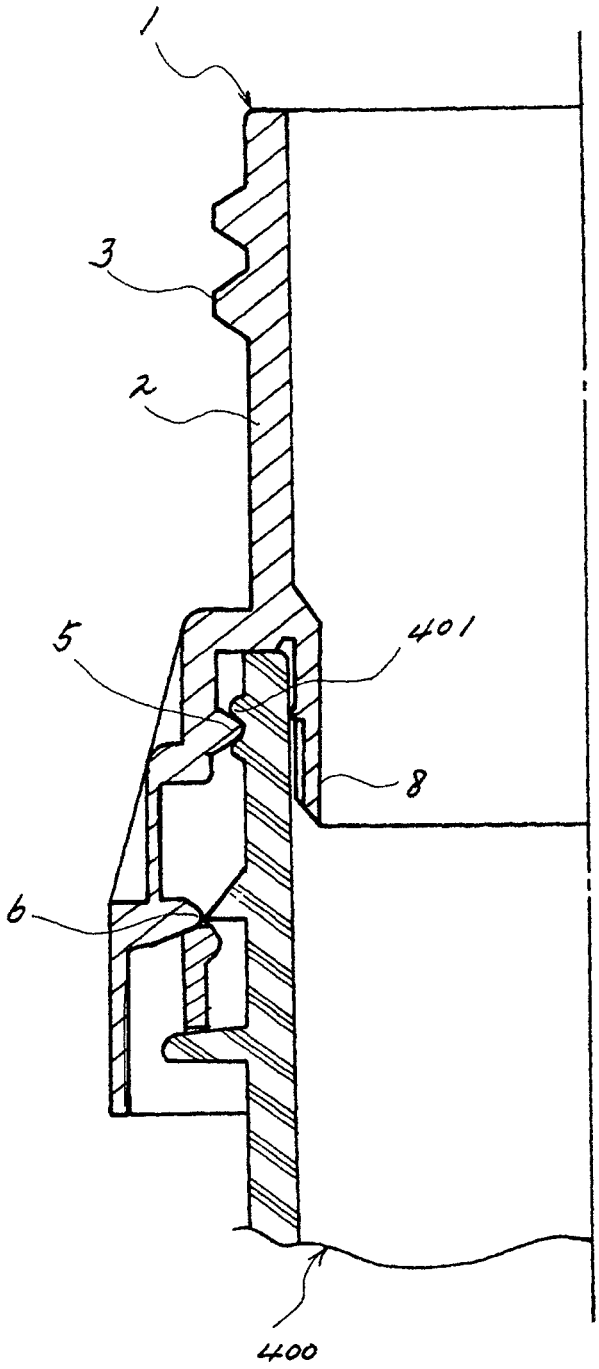

Also, FIG. 3 shows a state in which the connection device 1 is assembled with a container neck 300 having a container neck screw thread 301 of about 30 MM, and FIG. 4 shows a state in which the connection device 1 is coupled to a container neck 400 having a container neck screw thread 401 of about 26.78 MM.

Figure 5:
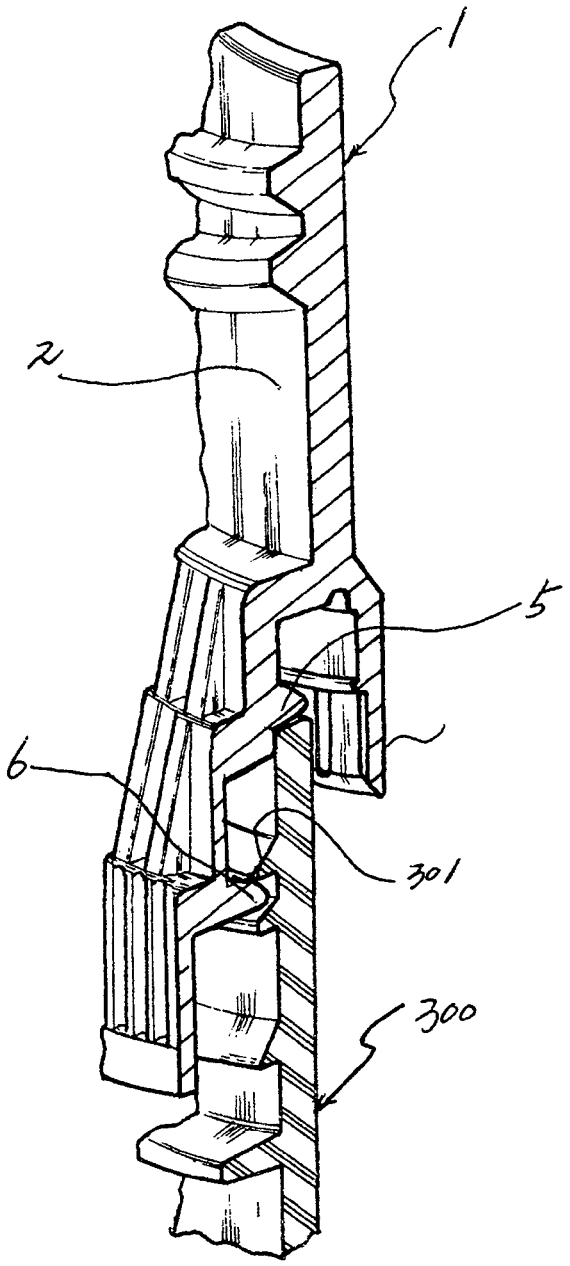
FIG. 5 is a partial cut-off perspective view of a main part in the state in which a bottle lid is assembled with the container neck.

Also, FIG. 5 shows a partial cut-off perspective view of a main part in the state where the connection device 1 is assembled with the container neck 300 having the container neck screw thread of about 30 MM.

Figure 6:
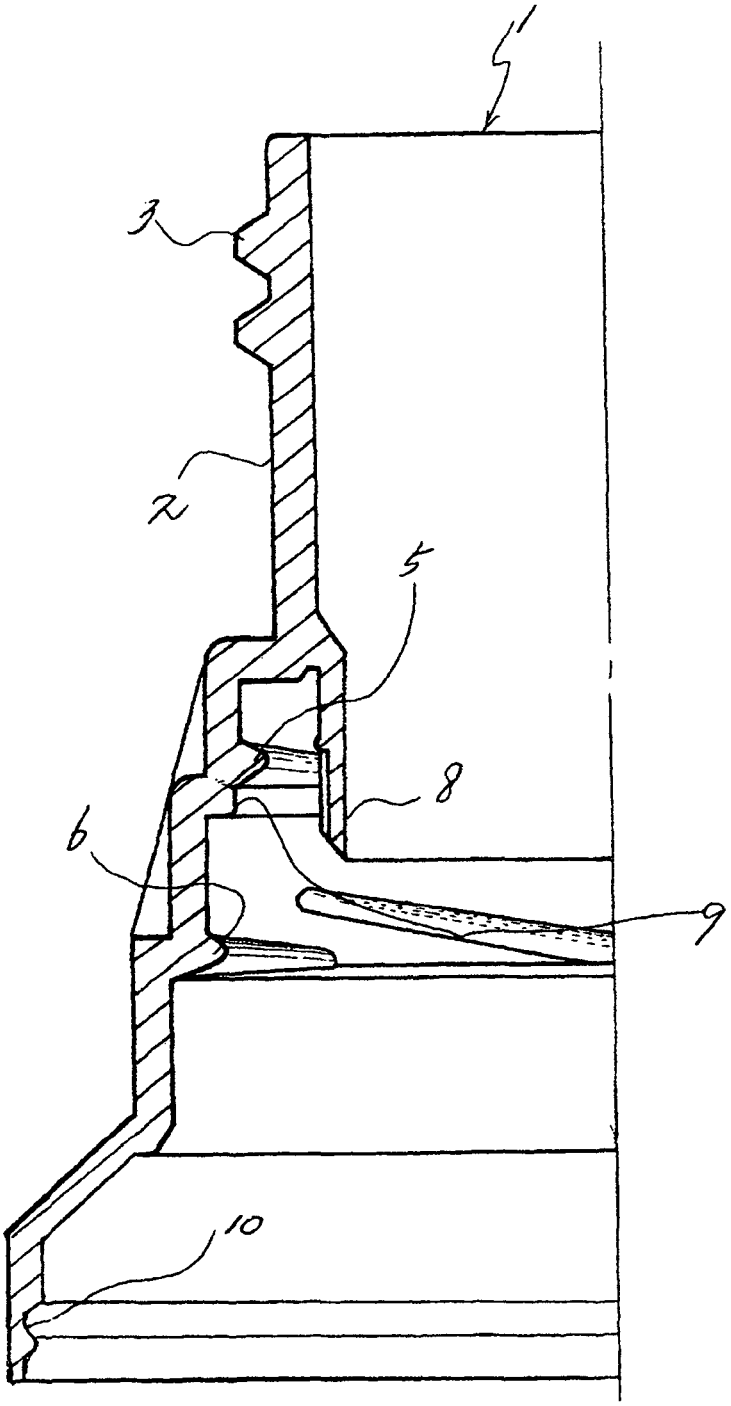
FIG. 6 is a semi-cross sectional view of further another embodiment of the present invention.

Also, FIG. 6 shows the connection device 1 including a can end coupling part 10 that is coupled to a can end so as to couple the connection device 1 having the above-descried structure to a steel can or an aluminum can. For the use of the can end coupling part 1, the can end is opened, and then the can end coupling part 10 is disposed with respect to the can end of the container to press the connection device 1. Then, the can end coupling part 10 may be elastically climbed over the can end and be coupled to the can end.

A bottle lid 100 may be separately coupled to the mouth part 2 of the above-described connection device 1 (with reference to FIG. 6), and the standard of the container neck applied to the first and second screw threads 5 and 6 may be selected to correspond to the standard of the container neck, such as 25.0 MM, 26.2(26.0) MM, 26.78 MM, and 28.0 MM. Also, the screw thread part 4 on which the first screw thread 5 or the second screw thread 6 is disposed may have a specifically thinned thickness so that a surface of the corresponding screw thread part 4 is elastically applied according to a size of the screw thread of the container neck.

Figure 7:
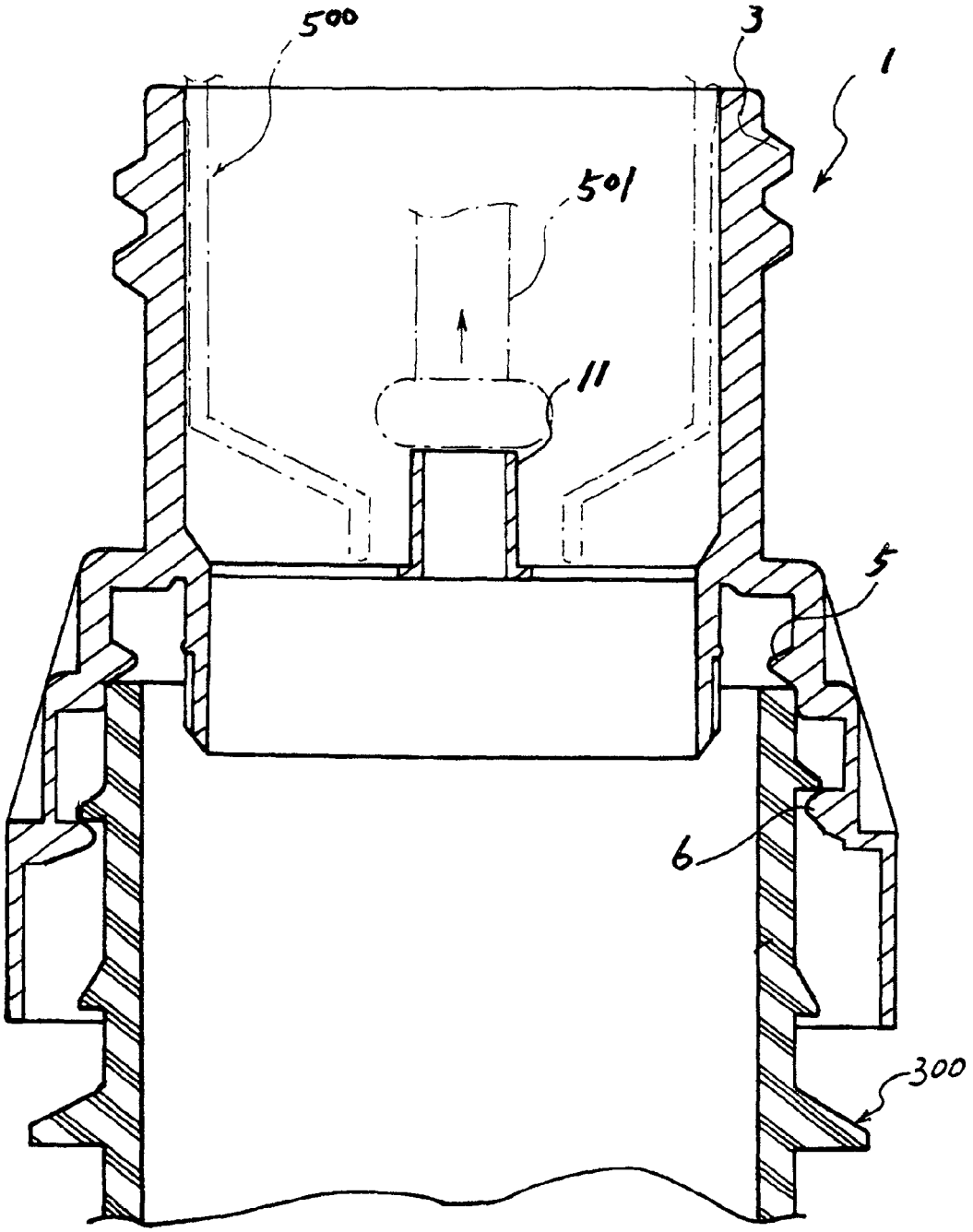
FIG. 7 is a cross-sectional view illustrating another example of the present invention.

In another embodiment, FIG. 7 illustrates an example in which a punching part 11 is disposed in the connection device 1, and when an accommodation part 500 filled with a different kind of material (hereinafter, referred to as a "different material") is assembled with the connection device 1, an opening unit 501 of the accommodation part 500 may be opened by the punching part 11 to allow different material filled in the accommodation part 500 to be dropped and mixed. Thus, the punching part 11 may have various structures, and for example, the punching part 11 may push and open a lower portion of the accommodation part 500 or tear a portion of a surface of the accommodation part 500.

As further another embodiment of the present invention (see FIG. 8), the present invention may be designed so that the connection device 1 of the present invention is capable of being coupled to containers having various standards. According to the features, a screw thread part S has a predetermined angle and a thin thickness.

Figure 8:
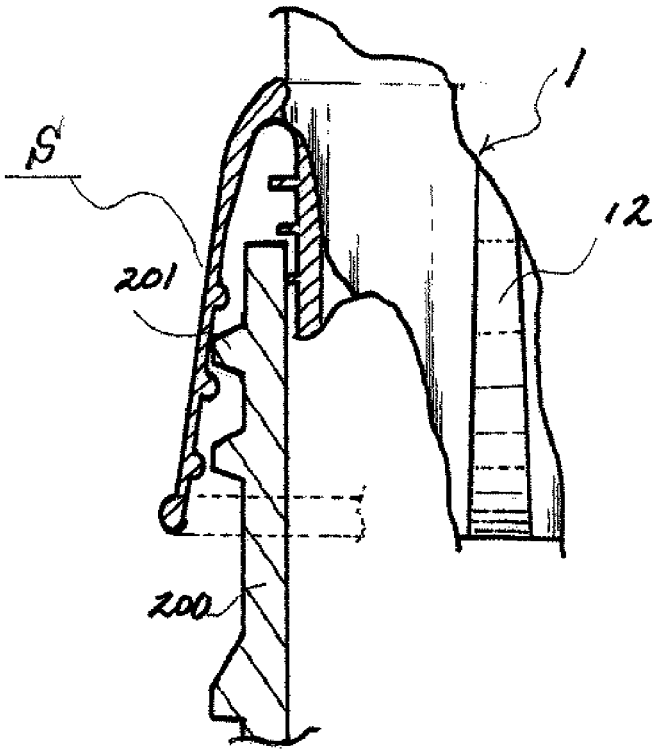
FIGS. 8 to 18 are cross-sectional views of a main part according to further another embodiment of the present invention.

Also, in use, FIG. 8 illustrates an initial state that is assembled with the container neck 200. In this state, when the connection device 1 further rotates, the connection device 1 contacts the screw thread 201 and is flexibly expanded outward according to a size of the screw thread 201 and thus be coupled to the screw thread 201. Here, to improve the flexibility, other rubber material such as silicon may be double-injected to a predetermined portion.

Figure 9:
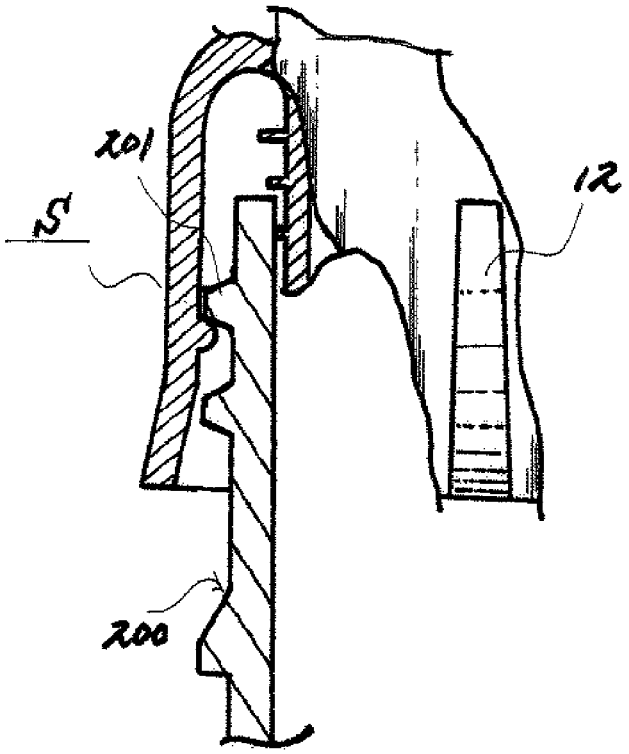

As further another embodiment of the present invention (see FIG. 9), the current embodiment is similar to that of FIG. 8. However, according to features of the current embodiment, the screw thread part S has a predetermined thickness, and a portion of a screw thread part S is cut to improve elasticity (flexibility) of the screw thread part S. Then, the cut portion is treated as a flexible part 12. Here, this may be molded by using the multi-injection molding machine.

The flexible part 12 may be formed of a soft synthetic rubber material such as silicon.

According to further another embodiment of the present invention (see FIGS. 10 and 11), to apply the connection device to container necks having standards different from each other by using a single screw thread part S, the screw thread part S has to have flexibility (elasticity). For example, when the screw thread part S is disposed on the screw thread 201 of the container neck 200, the screw thread part S may spread outward along an outer diameter of the screw area 201 by a space 13 or be pushed inward, and thus is closely-attached to the screw thread 201.

Figure 10:
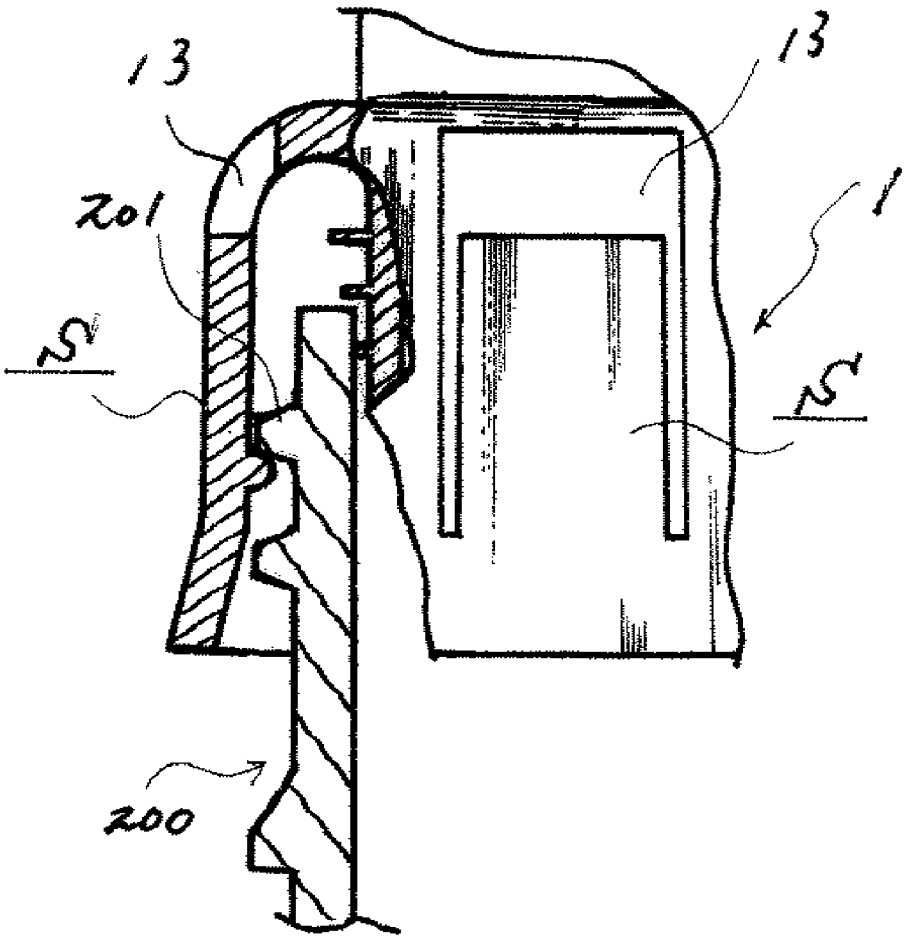
Figure 11:
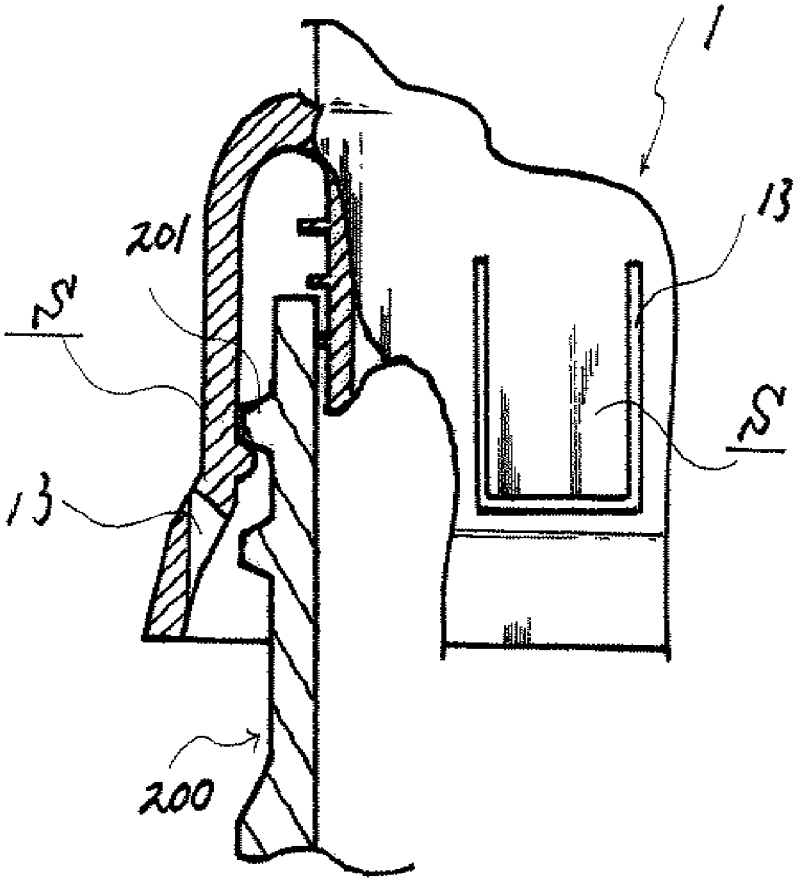

For supplemental explain, FIGS. 10 and 11 illustrate an initial state in which the connection device 1 is assembled with the container neck 200. In this state, when the connection device 1 rotates toward the container neck 200, in the case of FIG. 10, an upper portion of the screw thread part S spreads outward with respect to a lower portion thereof or disposed inside the lower portion. Also, in the case of FIG. 11, the lower portion of the screw thread part S is flexible inward or outward with respect to the upper portion thereof. This may depend on a position of a cut space 13. That is, the cut space 13 may be set at various angles in vertical or horizontal directions.

Figure 12:
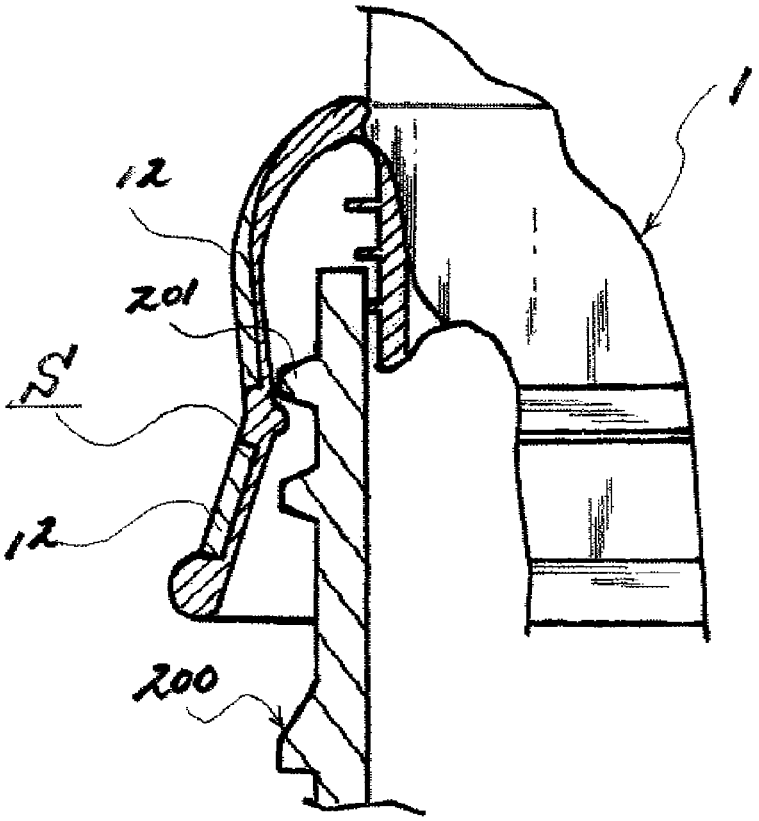

As further another embodiment of the present invention (see FIG. 12), upper and lower portions of the screw thread part S spreads outward with respect to a portion where the screw thread exists. Furthermore, to improve elasticity, a soft resin such as silicon may be added to at least one of the upper and lower portions to form a flexible part 12. The flexible part 12 may be preferably molded by using a multi-injection molding machine. (FIG. 12 illustrates a process of initially assembling the connection device 1 with the container neck 200)

Figure 13:
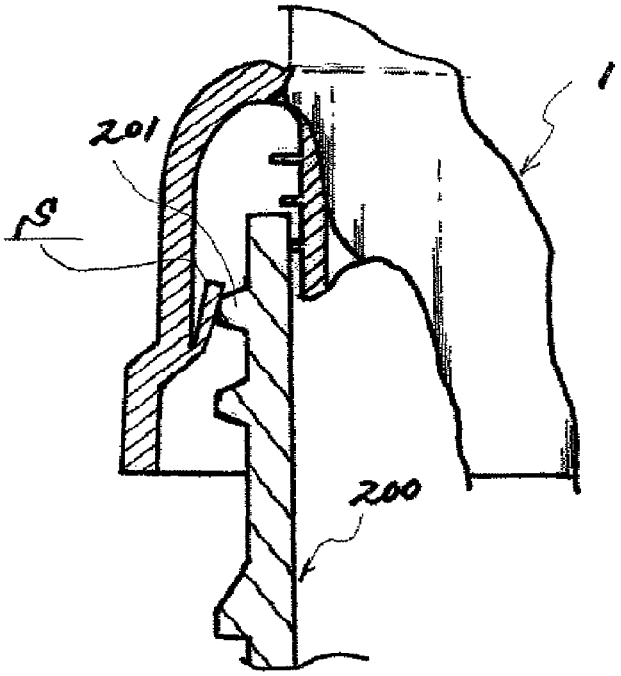

As further another embodiment of the present invention (see FIG. 13), FIG. 13 illustrates an example of a process of initially assembling with the container neck 200. According to feature of the current embodiment, a foldable screw thread part S is provided inside the connection device 1. The foldable screw thread part S is inclined downward when injection molding is performed, and then, is maintained upward at a predetermined angle through a past-process. Thus, the foldable screw thread part S has elasticity.

Thus, the screw thread part S is assembled with the screw thread 201 along the screw thread 201 in a state where the screw thread part S spreads outward according to the size of the screw thread 201 of the container neck 200 or while maintaining inward elasticity. The foldable screw thread part S may have a circular shape or be a plurality of independent screw threads S of which a predetermined portion is cut. Also, when the screw thread part S has a circular shape, the screw thread part S may have a predetermined slope (angle) to correspond to the screw thread 201.

Figure 14:
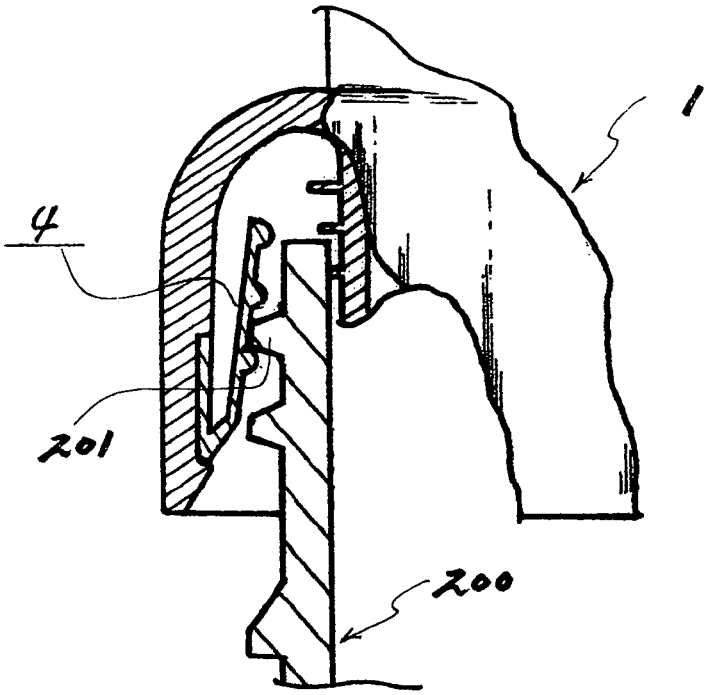
Figure 15:
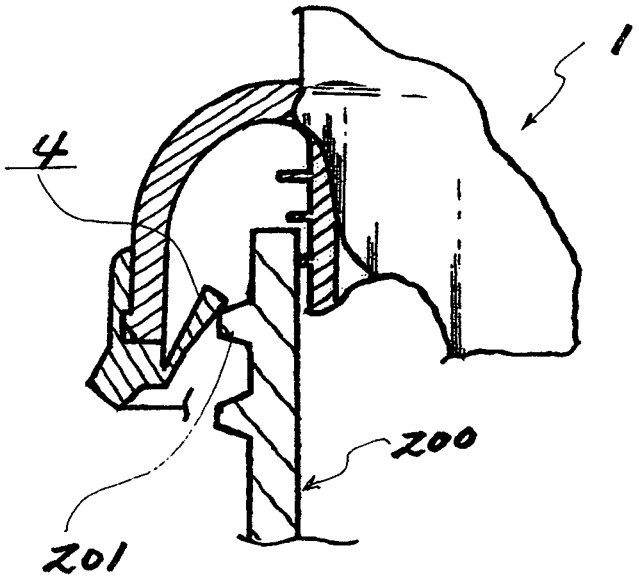

As further another embodiment of the present invention (see FIGS. 14 and 15), the screw thread part S is separately formed of a material having excellent elasticity to maximize the elasticity thereof, and the screw thread part S is assembled with the inside or the outside of the connection device 1. FIGS. 14 and 15 illustrate an initial state in which the connection device 1 is assembled with the container neck 200.

As further another embodiment of the present invention (see FIGS. 16 and 17), the screw thread part S faces an upper side with respect to the lower side thereof. To realize the screw thread part S having a predetermined angle, an upper-opened space 13 is provided in consideration of manufacture of a mold. Also, at least two screw thread parts S may be operably provided on the container neck 200

Figure 16:
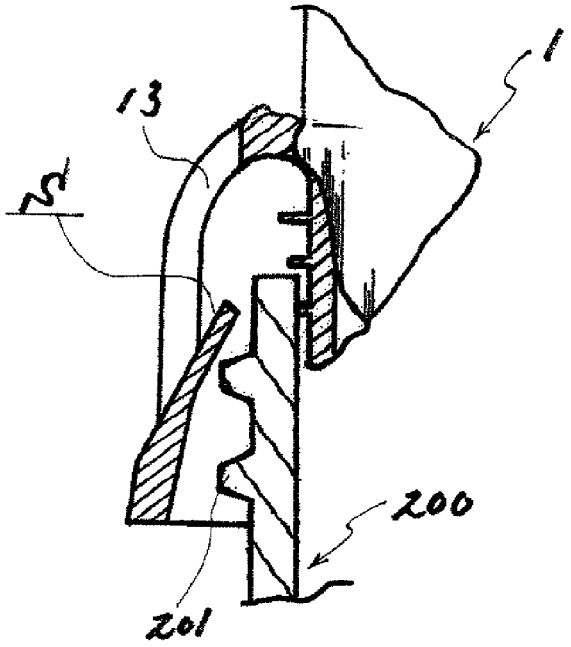
Figure 17:
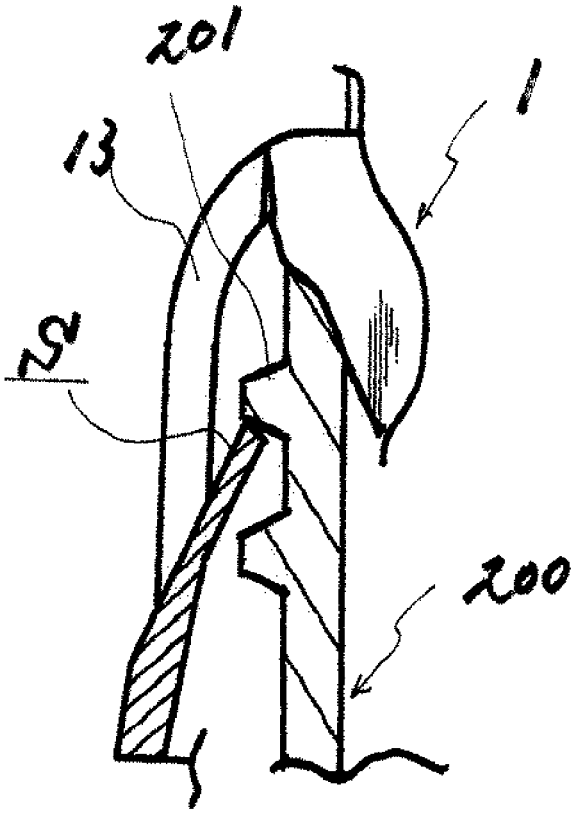

Also, FIG. 16 illustrates an initial state in which the connection device is assembled with the container neck, and FIG. 17 illustrate a state in which the connection device is assembled with the container neck. That is, the screw thread part is in a state in which an end of the screw thread part is lifted from the outside of the screw thread part toward an upper end inside of the screw thread part.

Figure 18:
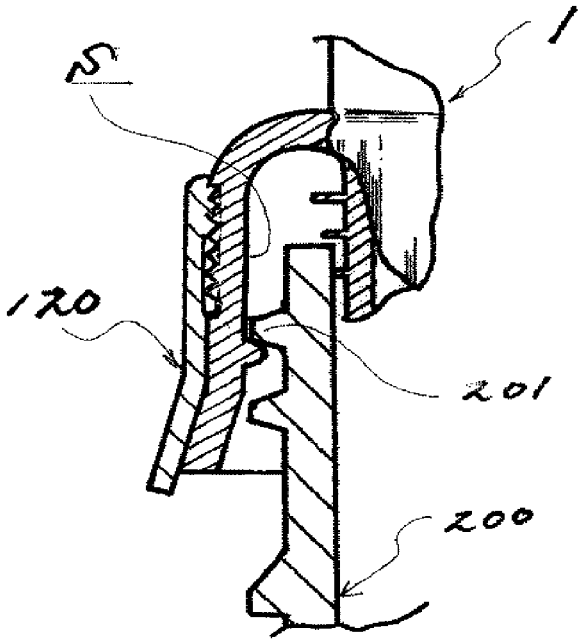

As further another embodiment of the present invention (FIG. 18), when an auxiliary support 120 is screw-coupled to the outside of the connection device 1 in a rotation direction, the screw thread part S is clamped inward so that any container neck or the other container neck having a similar standard may be applied to the screw thread. In some cases, a predetermined portion of the screw thread part S may be maintained in a cut shape.

Figure 19:
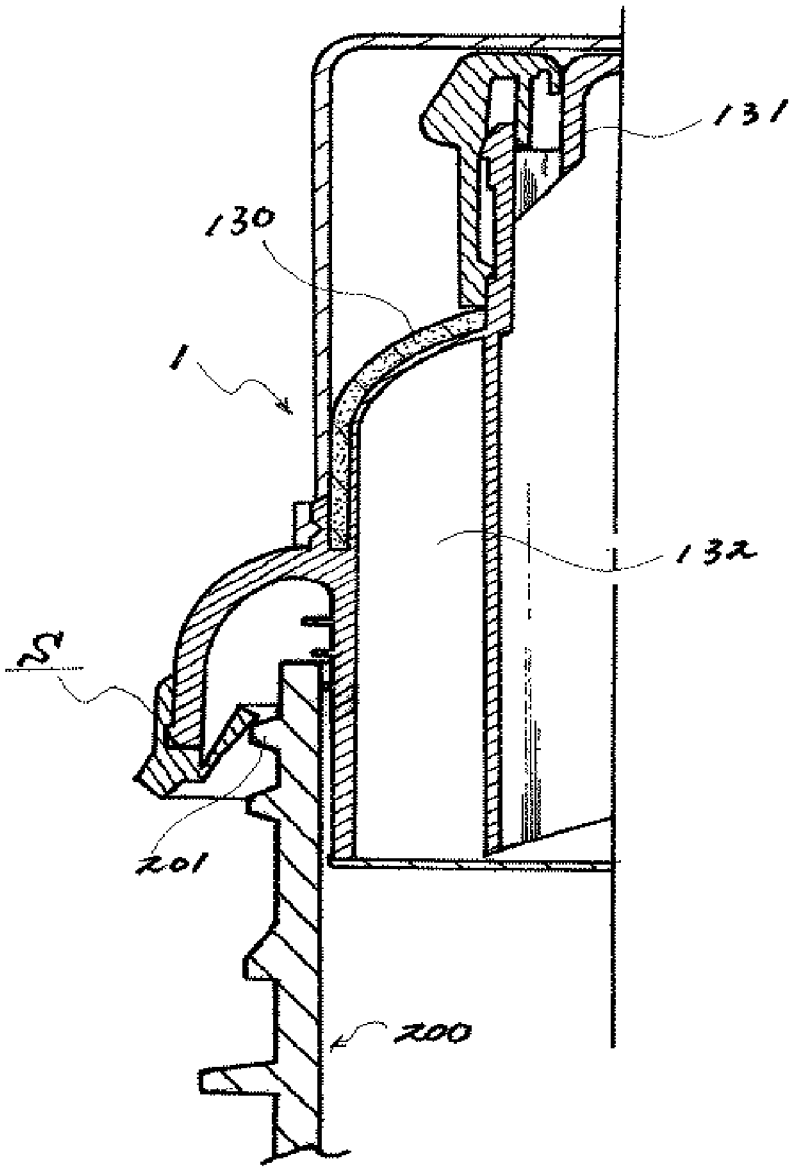
FIGS. 19 to 20 are semi-cross sectional views of further another example of the present invention.

As further another embodiment of the present invention (see FIG. 19), FIG. illustrates a storage space 132 filled with the different material may be defined in the connection device 1 having the various screw thread parts S (FIG. 19 is an initial state in which the connection device is intended to be coupled to the container neck).

In use as described above, when a cover disposed on the outside or an elastic part 130 formed of a soft resin such as silicon or the like is removed, and an end on which a stopper 131 is disposed is pressed, the elastic part 130 is folded downward. Simultaneously, a breaking protrusion disposed under the stopper 131 to lengthily extend may break a sealing part, which has a thin film shape to seal a lower end of the storage space 132, so that the different material within the storage space 132 drops down and is mixed.

Figure 20:
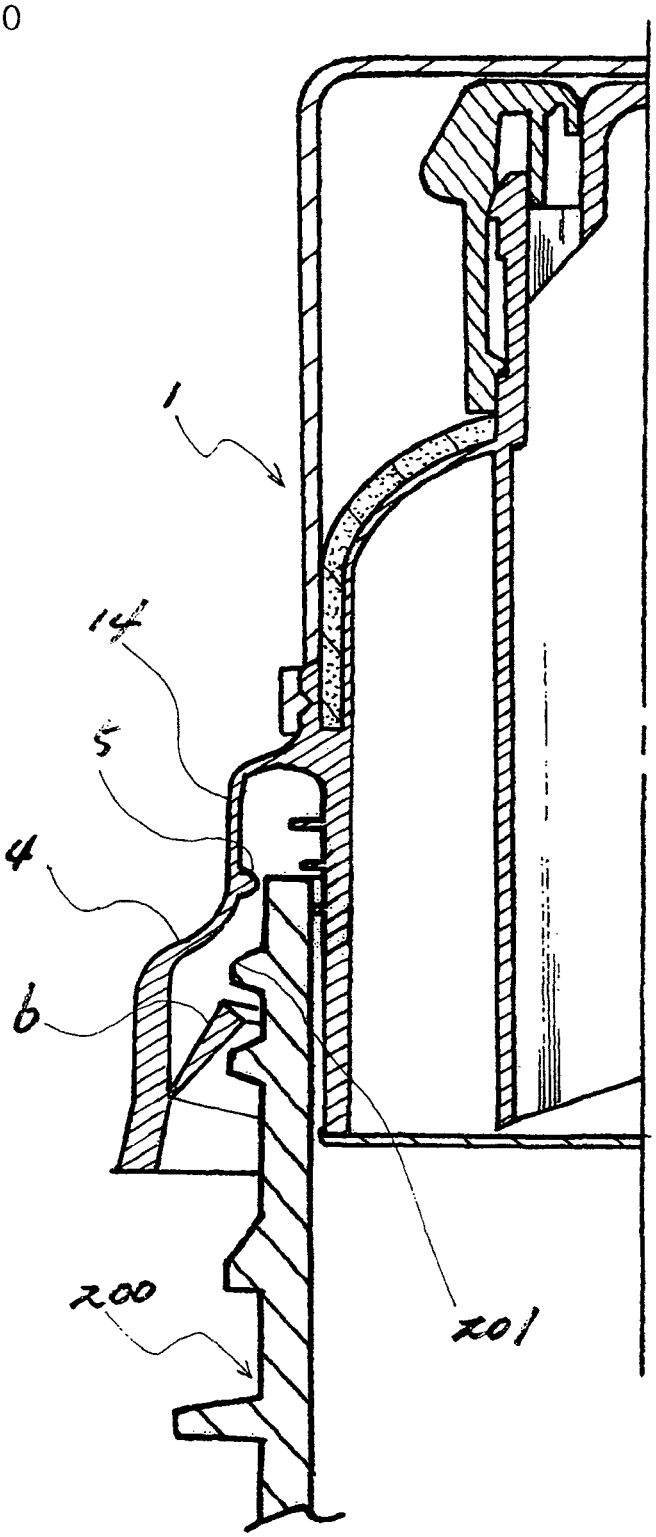

According to further another embodiment of the present invention (see FIG. 20), a screw thread part S of the present invention includes a first screw thread 5 having a thin thickness to provide elasticity. A second screw thread 6 disposed under the first screw thread 5 is foldable. Thus, when the first screw thread 5 operates and then is coupled to the container neck 200, the second screw thread 6 may provide the elasticity so that the connection device 1 moves downward without being disrupted with respect to a skirt of a bottle lid remaining on the container neck 200. Here, the second screw thread 6 may be manufactured in a partially cut shape.

For reference, the screw thread part 4 may be called a coupling part, and the present invention may have the same means.

INDUSTRIAL APPLICABILITY

In a case where the bottle neck is not coupled to the container, but is separately distributed, when the consumer purchases the bottle lid to couple the bottle lid to a pre-stored container or to a separately purchased container after a bottle lid coupled to the separately purchased container, the connection device of the present invention may be used as a medium for coupling the bottle lid to the container neck, which have different sizes from each other.

The invention claimed is:

1. A connection device capable of coupling with container necks having different standards comprising:

a mouth part disposed on an upper side of the connection device, a lower coupling part disposed on a lower side of the connection device, wherein the lower coupling part has an interior portion and an exterior portion, a lower coupling part screw thread having a standard corresponding to that of a container neck, said lower coupling part screw thread being formed within the lower coupling part, and wherein:

the lower coupling part screw thread is formed in the interior portion of the lower coupling part so that the lower coupling part is configured to be capable of being coupled to different sizes of container necks, and the lower coupling part screw thread is configured to correspond to a screw thread formed on the container neck, and is located on a movable part which is located on a lower end of the lower coupling part, and the movable part is capable of being folded upward when the connection device is coupled to the container neck.

2. The connection device of claim 1, wherein the lower coupling part screw thread comprises a first screw thread portion and a second screw thread portion.

3. The connection device of claim 2, wherein the second screw thread portion has an inner diameter that is greater than that of the first screw thread portion.

4. The connection device of claim 1, wherein the lower coupling part screw thread part has a thickness thinner than that of the mouth part.

5. The connection device of claim 1, wherein a punching part for opening a storage space of an accommodation part to be separately assembled to the connection device, is disposed on the connection device.

6. The connection device of claim 1, wherein a storage space for accommodating a material different from that within the container having said container neck, is defined in the connection device.

7. A connection device capable of coupling with container necks having different standards comprising:

a mouth part disposed on an upper side of the connection device, a lower coupling part disposed on a lower side of the connection device, which lower coupling part has an interior portion and an exterior portion, a mouth part screw thread or other shape having a standard corresponding to that of a bottle lid formed on an upper portion of the mouth part, and a lower coupling part screw thread having a standard corresponding to that of a container neck, said lower coupling part screw thread being formed within the lower coupling part, and wherein:

when the lower coupling part is coupled to the container neck, the lower coupling part is adjusted to be expanded outward to accommodate a size of the container neck or a screw thread formed on the container neck in order to couple the connection device to the container neck, and the lower coupling part screw thread is configured to correspond to the screw thread formed on the container neck, and is located on a movable part which is located on a lower end of the lower coupling part, and the movable part is capable of being folded upward when the connection device coupled to the container neck.

8. The connection device of claim 7, wherein the lower coupling part has elasticity provided by a sufficiently thin thickness thereof.

9. The connection device of claim 7, wherein a portion of the lower coupling part is spreadable, and an elastic part formed of a soft resin is formed on the spreadable portion.

10. The connection device of claim 9, wherein the elastic part is multi-injection molded.

11. The connection device of claim 7, wherein the lower coupling part is elastic at a predetermined position so that when the lower coupling part is resisted by the screw thread formed on the container neck, the lower coupling part screw thread spreads outward.

12. The connection device of claim 7, wherein the lower coupling screw thread part is assembled to an inside of the connection device to correspond to the screw thread formed on the container neck.

13. The connection device of claim 12, wherein when the assembled lower coupling part contacts the screw thread formed the container neck, the lower coupling part is capable of spreading outward to different degrees to accommodate variation in the size of the container neck.

14. The connection device of claim 7, wherein the lower coupling part is configured to be capable of spreading outward to different degrees to accommodate variation in the size of the screw thread formed on the container neck, and the movable part is configured to be able to be moved from a position outside of the exterior portion the lower coupling part toward a position inside of the interior portion of the lower coupling.

15. The connection device of claim 14, wherein a space is defined in an upper end of the lower coupling part.

16. The connection device of claim 7, wherein an auxiliary support is disposed outside the connection device, and configured such that when the auxiliary support operates together with the connection device, the lower coupling part is clamped by the auxiliary support and tightened toward the container neck.

17. The connection device of claim 7, wherein a first screw thread having a thickness is formed on an inner upper end of the lower coupling part, which thickness is thinner than that of the mouth part, and a second screw thread is located on the movable part of the lower coupling part, which movable part is capable of being folded to different degrees to accommodate variation in the size of the screw thread formed on the container neck.

18. The connection device of claim 7, wherein a storage space for accommodating a material different from that within the container having said container neck, is defined in the connection device.

* * * * *